US012053094B1

(12) United States Patent
Lytle

(10) Patent No.: US 12,053,094 B1
(45) Date of Patent: Aug. 6, 2024

(54) MATTRESS TOPPER FOR SIDE-SLEEPERS

(71) Applicant: Joseph Christian Lytle, San Antonio, TX (US)

(72) Inventor: Joseph Christian Lytle, San Antonio, TX (US)

( * ) Notice: Subject to any disclaimer, the term of this patent is extended or adjusted under 35 U.S.C. 154(b) by 0 days.

(21) Appl. No.: 18/543,200

(22) Filed: Dec. 18, 2023

Related U.S. Application Data

(60) Provisional application No. 63/462,342, filed on Apr. 27, 2023.

(51) Int. Cl.
*A47C 21/00* (2006.01)
*A47C 27/00* (2006.01)

(52) U.S. Cl.
CPC ..... *A47C 27/001* (2013.01)

(58) Field of Classification Search
CPC .... A47G 9/062; A47C 21/026; A47C 17/045; A47C 27/001; A47C 21/00; A47D 15/003
See application file for complete search history.

(56) References Cited

U.S. PATENT DOCUMENTS 836,326 A * 11/1906 Kinyon ..... A47C 27/001 5/722
1,927,109 A * 9/1933 Abrams ..... A47C 21/026 5/187
2,550,293 A * 4/1951 Platis ..... A47C 27/001 5/733
4,630,863 A * 12/1986 Roberts ..... A47C 27/001 297/452.48
5,163,192 A * 11/1992 Watson ..... A47G 9/1027 5/490
5,701,620 A * 12/1997 Montross ..... A47C 27/001 5/661
6,751,816 B1 * 6/2004 Wechsler ..... A47G 9/062 383/4
8,661,586 B2 * 3/2014 Melcher ..... A61G 7/075 5/636
9,144,318 B1 * 9/2015 Lagier ..... A47C 3/16
9,433,302 B2 9/2016 Mojtabavi
10,258,164 B2 4/2019 Shi
(Continued)

FOREIGN PATENT DOCUMENTS

CN 104983238 A 10/2015
CN 210870666 U 6/2020
KR 20180033413 A 4/2018

*Primary Examiner* — Justin C Mikowski
*Assistant Examiner* — Ifeolu A Adeboyejo

(57) ABSTRACT

A mattress topper for side-sleepers comprised of a main bedding section which provides support for a user's torso and lower body, a head section which provides support for the user's head, and one or more connectors which provide optional, indirect attachment between the sections. When side-sleeping, the user's arm and shoulder can be positioned inside a gap between the main bedding section and the head section and the user's arm is further able to slide underneath the respective sections. The main bedding section and the head section are attached to each other indirectly such that they are allowed to flex around the user's arm or shoulder positioned inside the gap. The one or more connectors allow the user to control the amount of separation between the sections and the gap between sections may also be closed for back or stomach sleeping.

7 Claims, 4 Drawing Sheets

(56) References Cited

U.S. PATENT DOCUMENTS

| | | | | |
|---|---|---|---|---|
| D953,071 | S | 5/2022 | Parson et al. | |
| 2005/0204471 | A1* | 9/2005 | Ruiz | A47D 15/003 5/655 |
| 2013/0198962 | A1* | 8/2013 | Melcher | A61G 7/1021 5/636 |
| 2013/0269114 | A1 | 10/2013 | Wu | |
| 2013/0276238 | A1 | 10/2013 | Vega-Woller et al. | |
| 2016/0128489 | A1* | 5/2016 | Lesley | A47C 27/001 5/722 |

* cited by examiner

MATTRESS TOPPER FOR SIDE-SLEEPERS

BACKGROUND

The present invention relates generally to apparatuses to improve sleeping conditions, and more specifically, is a mattress topper for side-sleepers with special features to promote the improved rest and comfort of side-sleepers.

Many people sleep on their side either preferentially or because it helps them to manage issues relating to sleep apnea, joint pain, back pain, circulation, etc. However, there are also challenges associated with side-sleeping. Notably, many side-sleepers have trouble with their arms "falling asleep" due to nerve compression and in some cases poor circulation. In addition to compression of the arm, side-sleepers may also experience neck pain, shoulder pain, and/or pain due to the uneven resting posture of the sleeper's spine.

The mattress topper for side-sleepers remedies these common problems by enabling the user to take on new sleeping positions that wouldn't otherwise be possible.

SUMMARY

The disclosure of the present application includes details on three separate embodiments of the mattress topper for side-sleepers, referred to herein as embodiments A, B, and C.

The mattress topper for side-sleepers comprises a main bedding section which generally provides support for a user's torso and lower body, and a head section which is comprised of one or more head section members and which generally provides support for a user's head. The mattress topper for side-sleepers is also comprised of one or more connectors which provide an optional, adjustable connection between the main bedding section and the head section.

Each of the embodiments is designed so that when the head section and the main bedding section are separated by a gap, a user's arm and shoulder can be positioned inside the gap. The effect is to redistribute weight off of the user's arm and shoulder and allow the user's spine to maintain a more natural posture.

A unique feature of the mattress topper for side-sleepers is that, when the head section and main bedding section are separated by a gap and a user's arm and shoulder are positioned inside the gap, the user's arm is further able to move laterally underneath the head section and main bedding section.

A second unique feature of the mattress topper for side-sleepers is that, where suitable, one or more connectors between the head section and main bedding section are used to limit the amount of separation between the head section and the main bedding section.

A third unique feature of the mattress topper for side-sleepers is that, in an embodiment where the one or more connectors being used have an elastic component, the separation between the head section and the main bedding section is automatically adjusted for the user.

A fourth unique feature of the mattress topper for side-sleepers is that, in an embodiment where the one or more connectors attach to the head section indirectly, such that the connection does not occur immediately at the gap between the head section and main bedding section, the effect is that the head section is allowed to flex around an arm or shoulder positioned inside the gap.

A fifth unique feature of the mattress topper for side-sleepers is that, in an embodiment where the one or more connectors attach to the main bedding section indirectly, such that the connection does not occur immediately at the gap between the main bedding section and the head section, the effect is that the main bedding section is allowed to flex around an arm or shoulder positioned inside the gap.

A sixth unique feature of the mattress topper for side-sleepers is that, in an embodiment where the one or more connectors attach to the head section indirectly, such that the connection does not occur immediately at the gap between the head section and main bedding section, an arm positioned inside the gap can move laterally underneath the head section.

A seventh unique feature of the mattress topper for side-sleepers is that, in an embodiment where the one or more connectors attach to the main bedding section indirectly, such that the connection does not occur immediately at the gap between the main bedding section and the head section, an arm positioned inside the gap can move laterally underneath the main bedding section.

BRIEF DESCRIPTION OF THE DRAWINGS

Embodiment A (FIG. 1)

Embodiment B (FIG. 2)

Figure 2A:
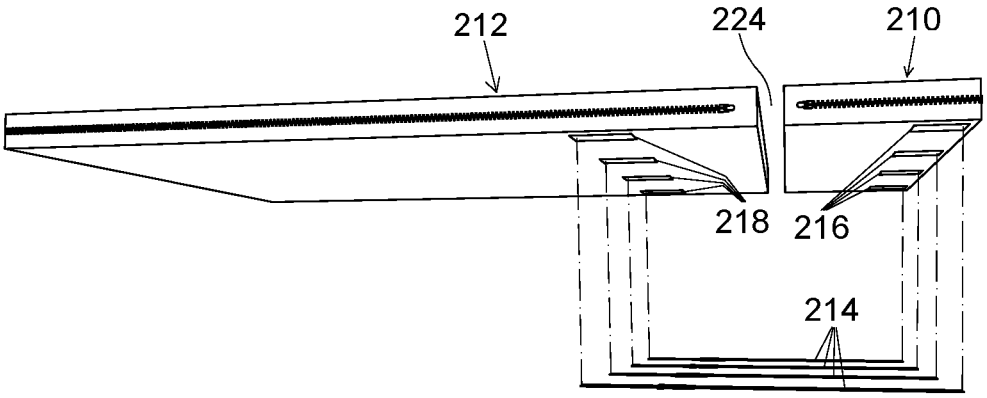

FIG. 2A shows an exploded, perspective view of a mattress topper for side-sleepers.

Figure 2B:
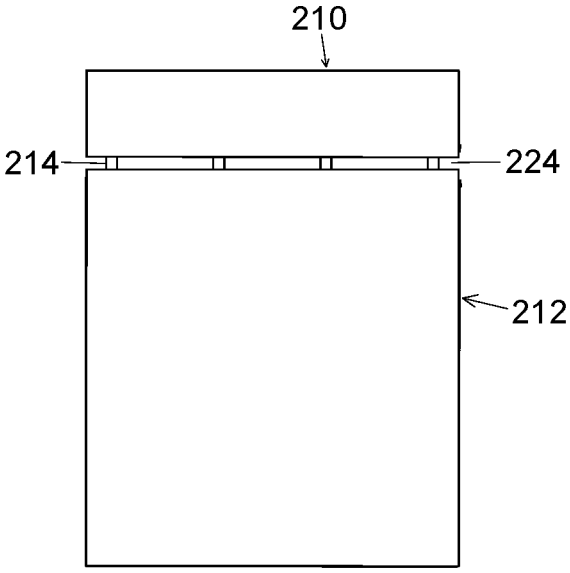

FIG. 2B shows a top view of the mattress topper for side-sleepers.

Figure 2C:
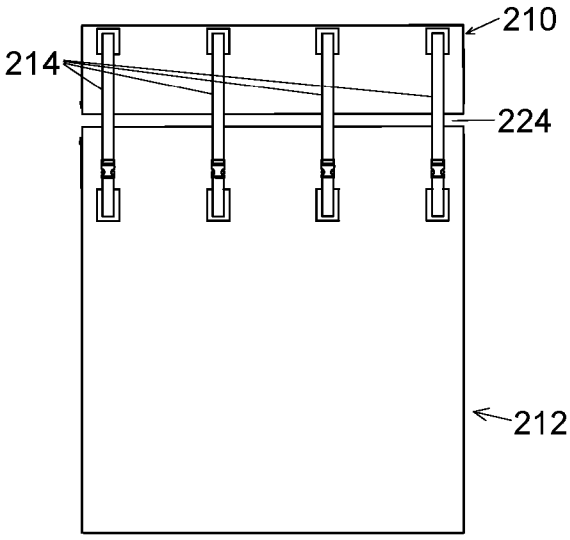

FIG. 2C shows a bottom view of the mattress topper for side-sleepers.

Embodiment C (FIGS. 3-4)

Figure 3A:
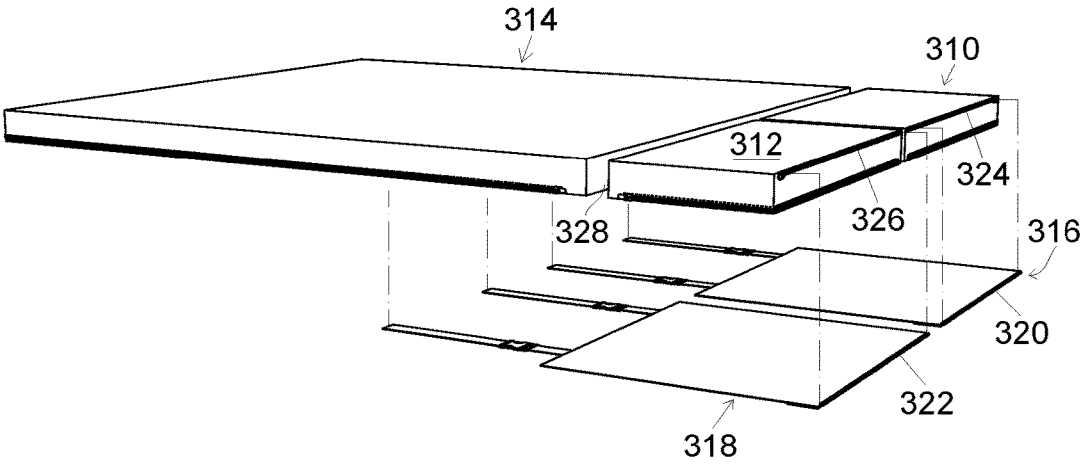

FIG. 3A shows an exploded, perspective view of a mattress topper for side-sleepers.

Figure 3B:
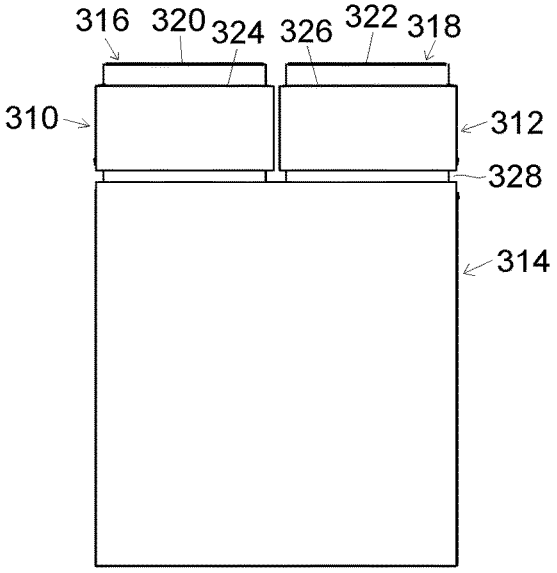

FIG. 3B shows a top view of the mattress topper for side-sleepers.

Figure 3C:
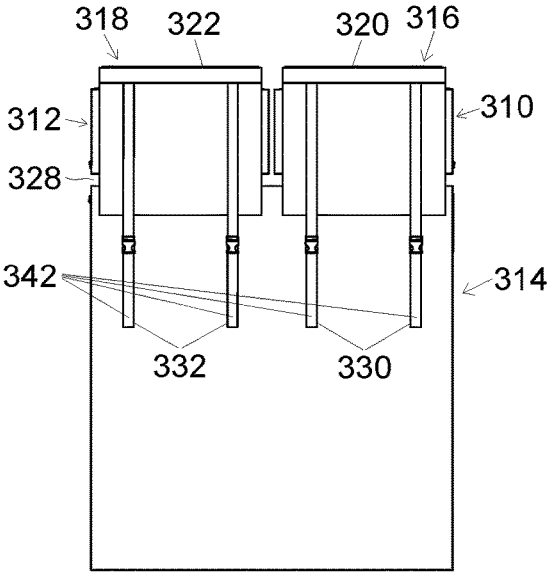

FIG. 3C shows a bottom view of the mattress topper for side-sleepers.

Figure 4A:
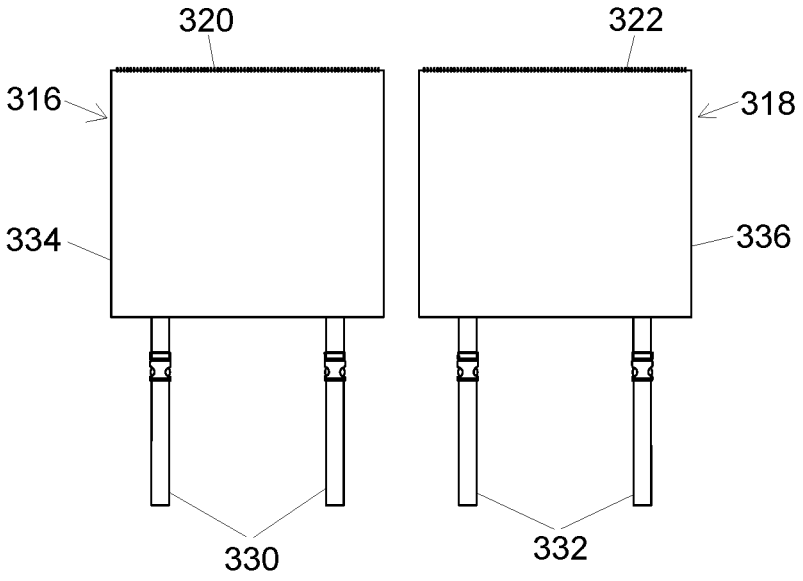

FIG. 4A shows a top view of one or more connectors.

Figure 4B:
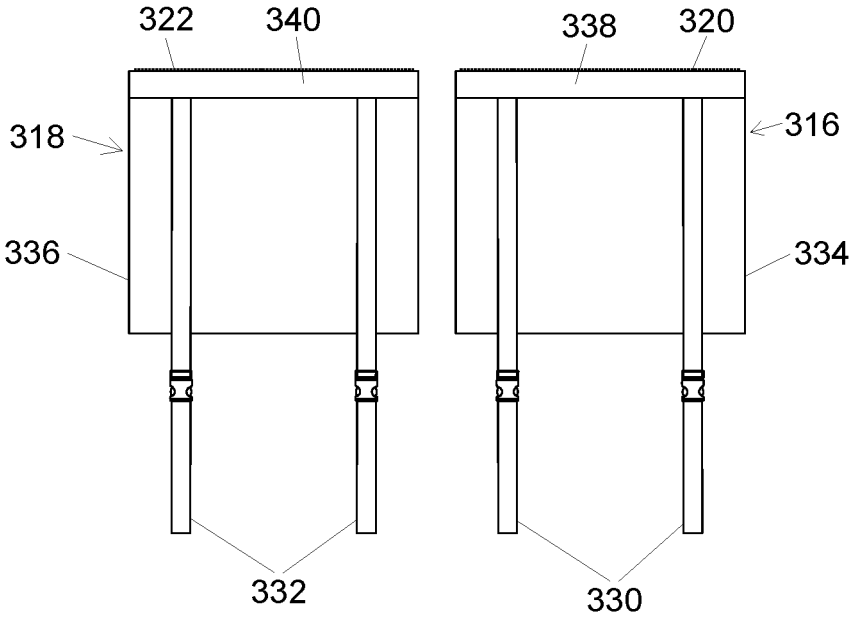

FIG. 4B shows a bottom view of the one or more connectors.

DETAILED DESCRIPTION

Figure 1A:
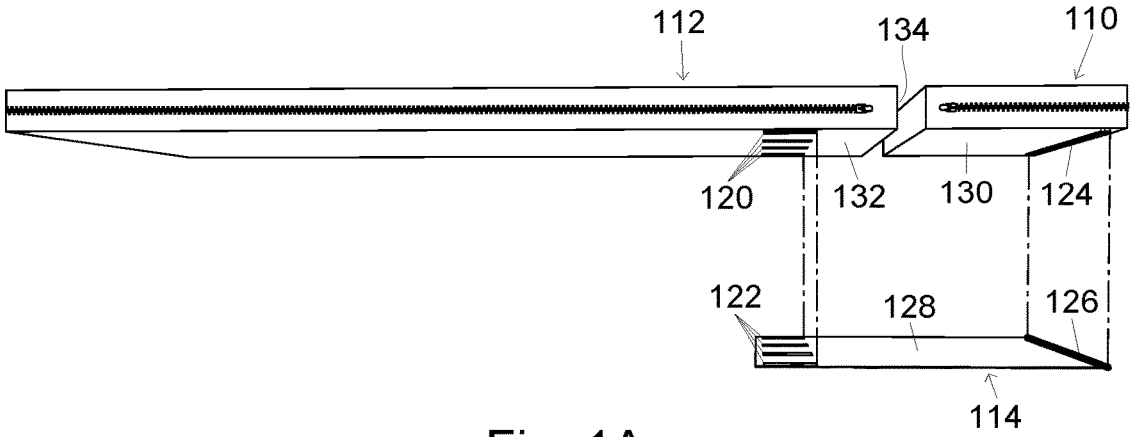
FIG. 1A shows an exploded, perspective view of a mattress topper for side-sleepers.
Figure 1B:
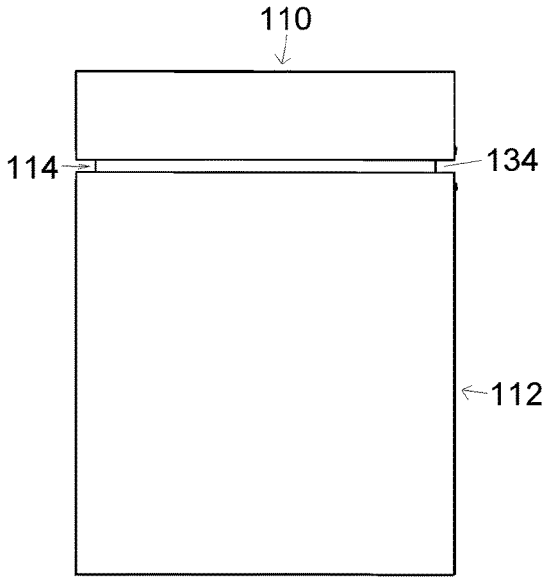
FIG. 1B shows a top view of the mattress topper for side-sleepers.
Figure 1C:
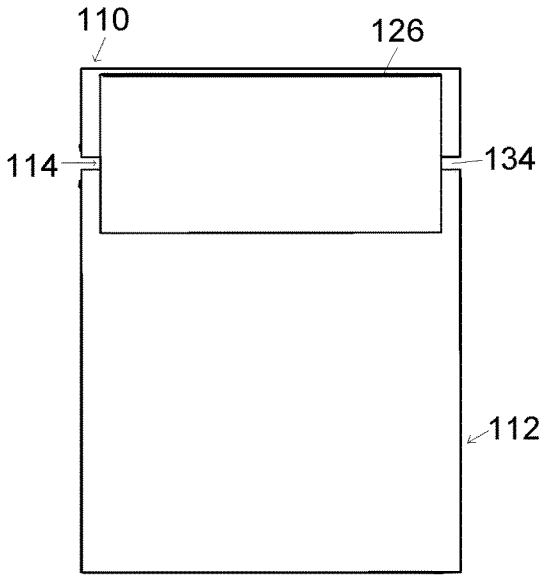
FIG. 1C shows a bottom view of the mattress topper for side-sleepers.

Embodiment A (FIG. 1)

In an embodiment, a mattress topper for side-sleepers comprises a main bedding section 112, a head section 110, and a panel section 114, which is comprised of one or more adjustable connectors and provides an optional, indirect connection between main bedding section 112 and head section 110 together from underneath.

The mattress topper for side-sleepers is laid out flat on top of a mattress. The mattress topper for side-sleepers is oriented so that head section 110 is at the head of the bed and main bedding section 112 is closer to the foot of the bed.

Panel section 114 is positioned underneath main bedding section 112 and head section 110 and makes contact with the bed.

Main bedding section 112 and head section 110 each comprise a case made of fabric or the like with bedding material (such as foam or other suitable filling) enclosed. The case may be separated from the filling material for washing.

A user is oriented with the user's head resting on head section 110 and with the user's torso and lower body resting on main bedding section 112.

When head section 110 is separated from main bedding section 112 by a gap 134, a user's arm and shoulder are free to settle into the gap 134 and the user's arm is further free to move laterally underneath head section 110 and main bedding section 112.

The case of main bedding section 112 has hook and loop components (such as Velcro) 120 fixed to it to allow for an easy, adjustable connection to corresponding hook and loop components 122 fixed to panel section 114.

The case of head section 110 is fitted with zipper-half 124 which connects to corresponding zipper-half 126 fixed to the edge of panel section 114.

As stated above, panel section 114 is fitted with zipper-half 126 which connects to corresponding zipper-half 124. Also, panel section 114 is fitted with hook and loop components 122 which form an adjustable connection with hook and loop components 120.

When panel section 114 is used to connect main bedding section 112 and head section 110 together it limits and allows customization of the gap 134 between main bedding section 112 and head section 110. If desired, panel section 114 can furthermore be adjusted to close gap 134.

To the extent that panel section 114 possesses inherent elasticity, gap 134 is automatically adjusted for the user.

Because panel section 114 forms an indirect connection with main bedding section 112, at hook and loop components 120 which are some distance away from gap 134, main bedding section 112 is able to flex around an arm or shoulder positioned inside gap 134.

Because panel section 114 forms an indirect connection with head section 110, at zipper-half 124 which is some distance away from gap 134, head section 110 is able to flex around an arm or shoulder positioned inside gap 134.

Also, because of the indirect connection of panel section 114 to main bedding section 112 and head section 110, a user's arm positioned inside gap 134 is free to slide underneath main bedding section 112 and head section 110 to find the most comfortable position. In other words, the user's arm can slide between surfaces 128 and 130, and between surfaces 128 and 132.

Embodiment B (FIG. 2)

In an embodiment, a mattress topper for side-sleepers comprises a main bedding section 212, a head section 210 and one or more adjustable connectors 214 that provide an optional, indirect connection between main bedding section 212 and head section 210 from underneath.

The mattress topper for side-sleepers is laid out flat on top of a mattress. The mattress topper for side-sleepers is oriented so that head section 210 is at the head of the bed and main bedding section 212 is closer to the foot of the bed. The one or more adjustable connectors 214 are positioned underneath main bedding section 212 and head section 210 and make contact with the bed.

Main bedding section 212 and head section 210 each comprise a case made of fabric or the like with bedding material (such as foam or other suitable filling) enclosed.

A user is oriented with the user's head resting on head section 210 and with the user's torso and lower body resting on main bedding section 212.

When head section 210 is separated from main bedding section 212 by a gap 224, a user's arm and shoulder are free to settle into the gap 224 and the user's arm is further free to move laterally underneath head section 210 and main bedding section 212.

The case of main bedding section 212 is reinforced with extra fabric (or other material) at 218 where the one or more adjustable connectors 214 are fixed.

The case of head section 210 is reinforced with extra fabric (or other material) at 216 where the one or more adjustable connectors 214 are fixed.

As stated above, the one or more adjustable connectors 214 are fixed onto the case of main bedding section 212 at reinforced sections 218. Also, the one or more adjustable connectors 214 are fixed to the case of head section 210 at reinforced sections 216.

When the one or more adjustable connectors 214 are used to connect main bedding section 212 and head section 210 together underneath, they limit and allow customization of the gap 224 between main bedding section 212 and head section 210. If desired, the one or more adjustable connectors 214 can furthermore be adjusted to close gap 224.

To the extent that the one or more adjustable connectors 214 possess inherent elasticity, gap 224 is automatically adjusted for the user.

Because the one or more adjustable connectors 214 form an indirect connection with head section 210, at reinforced sections 216 which are some distance away from gap 224, head section 210 is able to flex around an arm or shoulder positioned inside gap 224.

Because the one or more adjustable connectors 214 form an indirect connection with main bedding section 212, at reinforced sections 218 which are some distance away from gap 224, main bedding section 212 is able to flex around an arm or shoulder positioned inside gap 224.

Also, because of the indirect attachment of the one or more adjustable connectors 214 to main bedding section 212 and head section 210, a user's arm positioned inside gap 224 is free to slide underneath main bedding section 212 and head section 210 to find the most comfortable position. In other words, the user's arm can slide between main bedding section 212 and the one or more adjustable connectors 214, and between head section 210 and the one or more adjustable connectors 214.

Embodiment C (FIGS. 3-4)

In an embodiment, a mattress topper for side-sleepers comprises a main bedding section 314, a head section comprised of two head section members 312 and 310, and two connecting members 318 and 316. Connecting members 318 and 316 are each comprised of one or more adjustable connectors.

The mattress topper for side-sleepers is laid out flat on top of a mattress. The mattress topper for side-sleepers is oriented so that head section members 312 and 310 are at the head of the bed and main bedding section 314 is closer to the foot of the bed.

Connecting member 318 is, in large part, positioned underneath head section member 312 and main bedding section 314 and makes contact with the bed. A small portion of connecting member 318 bends up around head section member 312 such that zipper-half 322 can connect to corresponding zipper-half 326 at the top edge of head section 312.

Connecting member 316 is, in large part, positioned underneath head section member 310 and main bedding section 314 and makes contact with the bed. A small portion of connecting member 316 bends up around head section member 310 such that zipper-half 320 can connect to corresponding zipper-half 324 at the top edge of head section member 310.

Main bedding section 314 and head section members 312 and 310 each comprise a case made of fabric or the like with bedding material (such as foam or other suitable filling) enclosed. The cases may be separated from the filling material for washing.

A user is oriented with the user's head resting on head section member 310 or head section member 312 and with the user's torso and lower body resting on main bedding section 314.

When head section member 310 is separated from main bedding section 314 by a gap 328, a user's arm and shoulder are free to settle into gap 328 and the user's arm is further free to move laterally underneath head section member 310 and main bedding section 314.

When head section member 312 is separated from main bedding section 314 by gap 328, a user's arm and shoulder are free to settle into gap 328 and the user's arm is further free to move laterally underneath head section member 312 and main bedding section 314.

In an embodiment, connecting member 316 is constructed by sewing a plurality of strap & buckle assemblies 330 to a fabric panel 334. Indicator 338 shows where the fabric panel 334 is folded over the ends of strap & buckle assemblies 330 and sewn into place. Zipper-half 320 is then sewn into place as shown.

In an embodiment, connecting member 318 is constructed by sewing a plurality of strap & buckle assemblies 332 to a fabric panel 336. Indicator 340 shows where the fabric panel 336 is folded over the ends of strap & buckle assemblies 332 and sewn into place. Zipper-half 322 is then sewn into place as shown.

The remaining free ends of strap & buckle assemblies 330 and 332 are sewn to the underside of section 314 at the approximate locations indicated by 342.

Zipper-half 320 forms a connection with zipper-half 324. Zipper-half 322 forms a connection with zipper-half 326.

When connecting member 316 is used to connect main bedding section 314 to head section member 310, and when connecting member 318 is used to connect main bedding section 314 to head section member 312, connecting members 316 and 318 limit and allow customization of gap 328. If desired, connecting member 316 and connecting member 318 can furthermore be adjusted to close gap 328.

To the extent that connecting members 316 and 318 possess inherent elasticity, gap 328 is automatically adjusted for the user.

Because connecting member 318 forms an indirect connection with head section member 312, the connection being formed at zipper-half 326 which is some distance away from gap 328, head section member 312 is able to flex around an arm or shoulder positioned inside gap 328.

Because connecting member 318 forms an indirect connection with main bedding section 314, the connection being formed at the location indicated by 342 which is some distance away from gap 328, main bedding section 314 is able to flex around an arm or shoulder positioned inside gap 328.

Because connecting member 316 forms an indirect connection with head section member 310, the connection being formed at zipper-half 324 which is some distance away from gap 328, head section member 310 is able to flex around an arm or shoulder positioned inside gap 328.

Because connecting member 316 forms an indirect connection with main bedding section 314, the connection being formed at the location indicated by 342 which is some distance away from gap 328, main bedding section 314 is able to flex around an arm or shoulder positioned inside gap 328.

Also, because of the indirect attachment of connecting member 318 to main bedding section 314 and the indirect attachment of connecting member 318 to head section member 312, a user's arm is free to slide underneath main bedding section 314 and head section member 312 to find the most comfortable position. In other words, the user's arm can slide between head section member 312 and connecting member 318, and between main bedding section 314 and connecting member 318.

Also, because of the indirect attachment of connecting member 316 to main bedding section 314 and the indirect attachment of connecting member 316 to head section member 310, a user's arm is free to slide underneath main bedding section 314 and head section member 310 to find the most comfortable position. In other words, the user's arm can slide between head section member 310 and connecting member 316, and between main bedding section 314 and connecting member 316.

What is claimed:

1. An adjustable mattress topper comprising:

a head section which generally provides support for a user's head;

a main bedding section which generally provides support for the user's torso and lower body; and one or more adjustable connectors which provide an adjustable connection between said head section and said main bedding section;

wherein said mattress topper can be configured to allow the user's shoulder and arm to rest within a gap defined by a separation between said head section and said main bedding section; wherein said head section has a first end proximal to said gap and a second end distal to said gap; and wherein said one or more adjustable connectors extend underneath said head section and form a connection with said head section adjacent to the second end of said head section, wherein the user's arm can move laterally underneath said head section, between said one or more adjustable connectors and said head section.

2. The mattress topper of claim 1 wherein said one or more adjustable connectors can be configured to close said gap such that said head section and said main bedding section collectively constitute a continuous sleeping surface.

3. The mattress topper of claim 1 wherein said head section further comprises a plurality of independently connected head section members.

4. The mattress topper of claim 1 wherein said one or more adjustable connectors are selected from the group of straps, fabric panels, and zippers.

5. The mattress topper of claim 1 wherein said one or more adjustable connectors extend underneath said main bedding section where a connection is formed with said main bedding section.

6. The mattress topper of claim 1 wherein said one or more adjustable connectors extend all the way to the second end of said head section where a connection is formed at the second end of said head section.

7. The mattress topper of claim 1 wherein said one or more adjustable connectors extend all the way underneath said head section, and wrap up around the second end of said head section and attach on the top surface of said head section.

* * * * *